United States Patent [19]

Bauer et al.

[11] Patent Number: 4,755,110

[45] Date of Patent: Jul. 5, 1988

[54] PISTON-TYPE COMPRESSOR

[75] Inventors: Friedrich Bauer; Günter Hofstädter, both of Vienna, Austria

[73] Assignee: Hoerbiger Ventilwerke Aktiengesellschaft, Vienna, Austria

[21] Appl. No.: 75,295

[22] Filed: Jul. 17, 1987

Related U.S. Application Data

[63] Continuation of Ser. No. 894,489, Aug. 11, 1986, abandoned, which is a continuation of Ser. No. 758,385, Jul. 24, 1985, abandoned.

[51] Int. Cl.[4] ..... F04B 9/02; F04B 39/02

[52] U.S. Cl. ..... 417/364; 417/372; 137/855

[58] Field of Search ..... 418/84, 87, DIG. 1; 417/364, 372; 137/855; 92/79; 184/6.5

[56] References Cited

U.S. PATENT DOCUMENTS

| | | | |
|---|---|---|---|
| 1,546,570 | 7/1925 | Dennedy | 92/79 X |
| 1,872,805 | 8/1932 | Peterson | 92/79 X |
| 1,927,799 | 9/1933 | Mann | 91/493 X |
| 2,646,212 | 7/1953 | Kellie | 417/228 |
| 2,781,632 | 2/1957 | Meijer | 92/79 X |

FOREIGN PATENT DOCUMENTS

| | | | |
|---|---|---|---|
| 1055743 | 10/1959 | Fed. Rep. of Germany . | |
| 1013637 | 4/1983 | U.S.S.R. | 417/228 |

*Primary Examiner*—Leonard E. Smith
*Assistant Examiner*—Ted Olds
*Attorney, Agent, or Firm*—Watson, Cole, Grindle & Watson

[57] ABSTRACT

A piston-type compressor for gaseous media, e.g. a brake air compressor for automotive vehicles, particularly a compressor having capacity control means, is provided with an externally arranged lubricant pump for supplying the lubricant from a storage reservoir which is positioned below the compressor to a lubrication circuit of the compressor. A downwardly extending return line for the lubricant is provided between the otherwise enclosed crankcase of the compressor and the storage reservoir. In order to prevent a build-up of superatmospheric pressure in the crankcase, a self-acting check valve is installed in the return line the check valve serving to block flow of lubricant through the return duct toward the crankcase of the compressor.

7 Claims, 2 Drawing Sheets

PISTON-TYPE COMPRESSOR

This application is a continuation of application Ser. No. 894,489, filed Aug. 11, 1986, which was a continuation of Ser. No. 758,385, filed 7/24/85, both are now abandoned.

BACKGROUND OF THE INVENTION

1. Field of the Invention

The invention relates to a piston-type compressor for gaseous media, e.g., a brake air compressor for automotive vehicles, and in particular to a compressor having capacity control means, wherein the piston-type compressor is provided with an externally arranged lubricant pump for supplying lubricant from a storage reservoir and through the lubrication circuit of the compressor, and wherein a return duct for the lubricant leads from the otherwise enclosed crankcase of the compressor back to the storage reservoir.

2. The Prior Art

Piston-type compressors of the noted type are used in particular as brake air compressors for automotive vehicles. The compressor is driven by the engine of the automotive vehicle and is supplied with lubricant by the lubricant pump of the engine. Since brake air is required in an irregular manner, the compressor delivers it into a pressure receiver. When the receiver has been charged to its full pressure, delivery of the compressor is interrupted either by means for capacity control, e.g., a simple idling control, or by a pressure regulator which will simply vent any excess air delivered by the compressor into the atmosphere. Use is also made of regulating means holding the compressor inlet valve in its opened position, so that the aspirated medium will be forced back again into the suction line. With known piston-type compressors, an undesirable accumulation of lubricant will occur within the cylinder bore of the compressor, particularly during steady-state operation and also when idling. Such excess lubricant will cause excess oiling of the delivered gaseous medium. In brake compressors, such excess lubricant is vented into the atmosphere with the brake air, and during steady-state operation also with the excess air. Since brake air compressors are, as a rule, connected to the lubrication circuit of the automotive engines, these engines will show an increase lubricating oil consumption. Such excessively oiled air, furthermore, will cause increased environmental pollution, particularly on public thoroughfares such as, e.g., pull-offs at bus stops, where such excessively oiled air is vented. This problem cannot be solved by a decreased lubricant supply to the compressor, since this would engender the risk of overheating. Returning the excess air with its entrained oil to the intake manifold of the vehicle's engine is not only expensive but is also objected to by the engine manufacturers since, apart from the excessively oiled air, coked oil and other contaminants could also enter the combustion chamber.

SUMMARY OF THE INVENTION

It is the object of the invention to provide an apparatus for generating a compressed gaseous medium which includes a piston-type compressor, the apparatus including means to prevent an undesirable accumulation of lubricant within the compressor and in the delivered gaseous medium.

According to the present invention, the apparatus includes a piston-type compressor for gaseous media, e.g., a brake air compressor for automotive vehicles, particularly a compressor having capacity control means, and an externally arranged lubricant pump for supplying lubricant from a storage reservoir to a lubrication circuit of the compressor. A return passage for the lubricant is provided between the otherwise enclosed crankcase of the compressor and the storage reservoir. In order to prevent a build-up of superatmospheric pressure in the crankcase, a self-acting check valve is installed in the return duct which is led at a downward slope to a storage reservoir at a lower level, check valve serving to block flow through the return duct toward the crankcase of the compressor.

The present invention achieves its stated object by arranging in the return duct which is sloping down to a storage reservoir at a lower level, a self-acting check valve for blocking in the return duct any back-flow toward the compressor crankcase. In an unexpected manner, this simple measure effectively prevents excessive oiling of the delivered gaseous medium without impairing adequate lubrication of the compressor. The check valve arranged in the return duct allows an unimpeded return flow of lubricant to the storage reservoir. The check valve simultaneously prevents aspiration of air into the crankcase during the compression stroke of the compressor, which would cause a pressure buildup in the crankcase during the following suction stroke of the compressor, and such superatmospheric pressure would, particularly during steady-state operation, be higher than the pressure in the compression chamber of the compressor. Such an arrangement precludes the development of a pressure differential which would cause the lubricant to creep upwardly along the cylinder wall and enter the compression chamber. The lubrication circuit itself will not be impaired by this arrangement.

Is is already known from piston-type compressors of the above construction that lubricant accumulating in the crankcase can be returned to the storage reservoir by a return duct of adequate cross section and downward slope. In such instances, no valve is provided in the return duct, and is also not required, since, due to the downward slope, no lubricant could flow back into the crankcase. If the storage reservoir, e.g., the oil sump of the prime mover, is located at a level above that of the crankcase of the compressor, a special return flow arrangement for the lubricant will be required. It is already known that this can be accomplished by providing in the return duct a delivery pump and a check valve opening in the direction of delivery, wherein it is also possible to utilize pressure fluctuations in the crankcase for pumping. The aforesaid check valve serves to prevent a backflow of the lubricant due to the difference in levels.

According to the invention, but contrary to the aforesaid arrangement, the check valve is located in a return duct having a downward slope which in itself would prevent a back-flow of lubricant. The purpose of the check valve herein is to cause a subatmospheric pressure in the compressor crankcase, in order to prevent lubricant from being forced out of the crankcase and into the compression chamber of the compressor.

In the piston-type compressor as per the invention, the check valve is preferably located immediately adjacent to the crankcase and is constructed as the lamina valve. The crankcase volume can thus be kept as small as practicable, so that retardation of the decompression rate by too large a volume can be avoided. The lamina valve requires only little space and can be designed with low flow resistance, so that the returning lubricant can pass through without any great encumbrance.

A simple embodiment of the invention consists in the return duct being formed by a port in the crankcase wall of the compressor and a communicating drain bore within a machine component joined to the crankcase, wherein the check valve consists of a flexible valve lamina fixed between the crankcase and the aforesaid machine component joined to the crankcase, with the aforesaid lamina valve controlling the port in the crankcase wall. The check valve used in this embodiment is especially simple and practically consists of a single flexible lamina. This embodiment is particularly suitable for constructions where the compressor is directly attached to the housing of a prime mover. The drain bore may, herein, open directly into the crankcase of the prime mover. The check valve arranged as per invention may, however, also be inserted in the line tubing, e.g., into a union of the tubing, and in such instances the check valve will suitably be constructed as valve insert.

A preferred application of the invention is with brake air compressors for automotive vehicles, the compressors being driven by the vehicle's engine and supplied with lubricant by the engine's lubricant pump. As per invention, the check valve is herein installed in the return line ducted from the crankcase of the compressor back to the oil sump of the vehicle engine. The check valve will prevent excess oiling of the delivered air and thus also environmental pollution by brake air vented from the automotive vehicles.

DETAILED DESCRIPTION OF THE EMBODIMENTS

Figure 1:
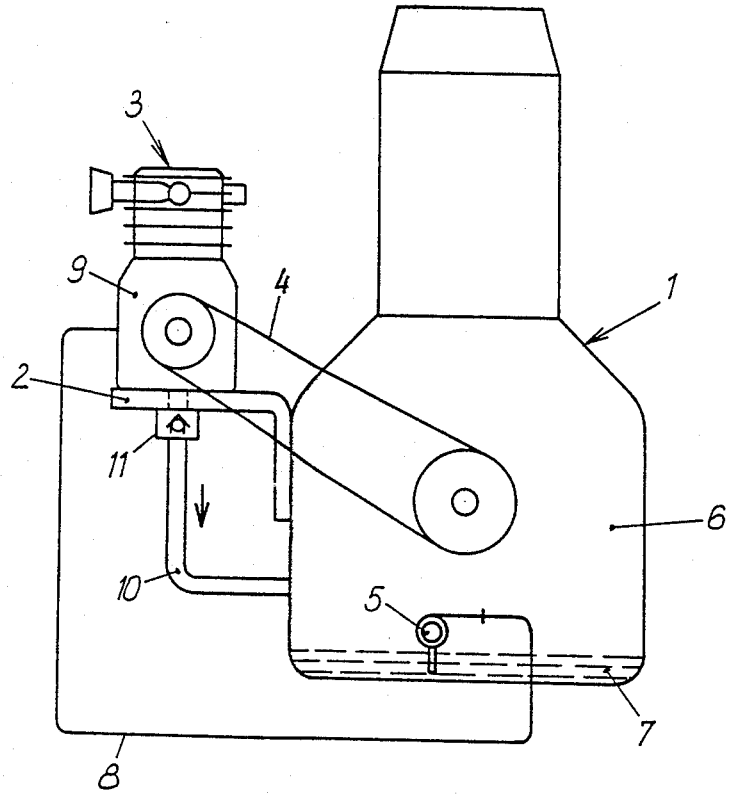
FIG. 1 shows in schematic representation a side view of a piston-type compressor as per invention, mounted on a prime mover.

Shown in FIG. 1 is an internal combustion engine 1, e.g. an automotive engine, on the housing of which there is mounted on a pedestal 2 which supports a typical compressor 3, e.g., a brake air compressor. The compressor 3 is driven by the engine 1 by a belt drive 4. Lubrication of the compressor 3 is effected by an externally located lubricant pump 5 which, in this embodiment, is located within the crankcase 6 of the internal combustion engine 1 and simultaneously supplies the lubrication circuit of the engine 1. The lubricant pump 5 draws lubricant from the oil sump 7 of the engine 1 and delivers the lubricant through the lubricant line 8 to the crankcase 9 of compressor 3. From there, the pressurized lubricant is distributed through lubrication passages to lubrication points and also sprayed from the passages into the crankcase 9, whereby the cylinder wall is also supplied with lubricant. A return duct 10 is led from the crankcase 9 back into the crankcase 6 of engine 1.

Figure 2:
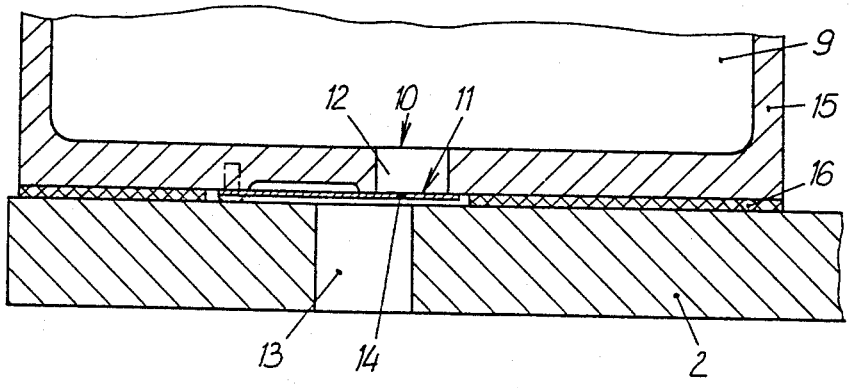
FIG. 2 shows, on an enlarged scale, a cross sectional view of a detail of FIG. 1 that includes the check valve at the bottom of the crankcase of the compressor.
Figure 3:
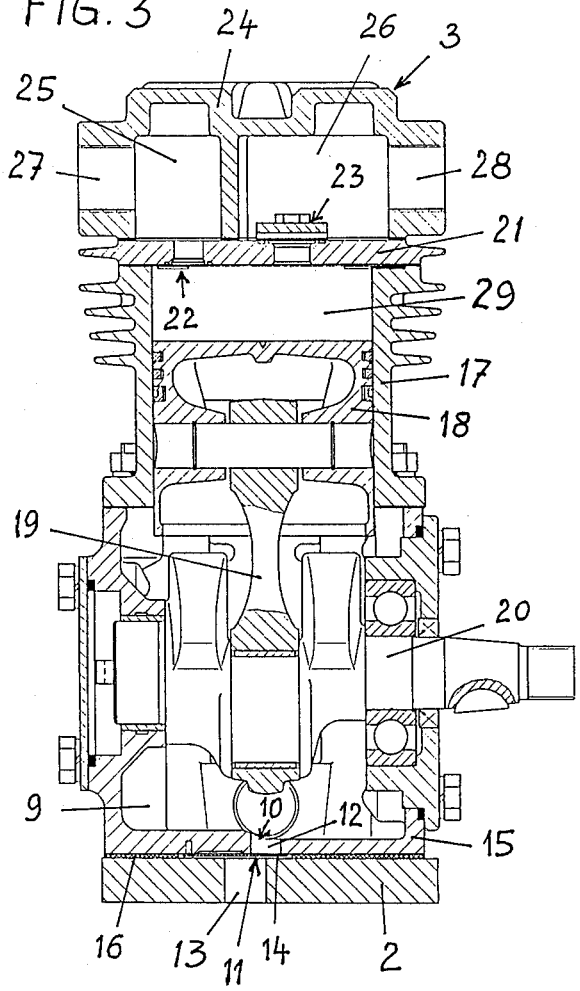
FIG. 3 shows a cross sectional view through the piston-type compressor of FIG. 1 and a portion of the pedestal on which it is mounted.

The construction of the brake air compressor 3 is shown in FIG. 3. It includes a crankcase 15, a cylinder 17 mounted on the crankcase and a piston 18 movably positioned in the cylinder. The piston 18 is driven by a crankshaft 20 via a connecting rod 19. The crankshaft 20 is itself driven by the noted belt drive 4. The upper end of cylinder 17 is closed off by a valve seat disk 21, in which a suction valve 22 and a pressure valve 23 are positioned. Valve seat disk 21 is mounted on cylinder 17 by a cylinder head 24, in which a suction chamber 25 and a pressure chamber 26 are formed. Suction chamber 25 is connected to an intake opening 27 and the pressure chamber 26 leads to a pressure conduit 28. Within crankcase 15 a crank chamber 9 is provided in which the oil collects which, in accordance with FIG. 1, is fed to compressor 3 by way of lubrication line 8. At the bottom of crank chamber 9 there is a recirculating line 10 containing a built-in flap valve 11, which will be referred to again below with respect to FIG. 2.

When compressor 3 is operating, piston 18 is moved up and down within cylinder 17. The conveyed medium is sucked in through intake line 27 and suction chamber 25; it reaches, by way of suction valve 22, the cylinder area designated as 29 above piston 18 and is moved from there through pressure valve 23, pressure chamber 26, and pressure conduit 28 into the pressure system serviced by compressor 3. When piston 18 moves downward, a vacuum is created in cylinder area 29 because of the suction effect of the relatively large piston 18. This vaccum is caused by the resistance to the flow which suction valve 22 offers and this vacuum becomes particularly noticeable when the conveyance of compressor 3 is controlled by throttling of intake line 27, which is quite customary in the case of smaller compressors. In any case, a vacuum is created in cylinder area 29 which is smaller than the pressure within crank chamber 9. It must be noted that crank chamber 9 is usually relatively well sealed, so that the downward motion of piston 18 compresses the volume within crank chamber 9 and thus creates pressure inside of it which is higher than normal atmospheric pressure.

Thus there is a pressure differential between cylinder area 29 and crank chamber 9 whereby the pressure within the crank chamber is higher. This has the effect that oil, which condenses on the interior wall of cylinder 17 within crank chamber 9, moves upward along cylinder 17 and reaches cylinder area 29. The oil is conveyed from cylinder area 29 into pressure line 28, which is undesirable.

In order to overcome this problem, according to the invention a self-acting check valve 11 is installed in the return duct 10 (shown in FIG. 1 as a tube), which serves to block the flow in return duct 10 toward the crankcase 9 of the compressor 3. The check valve 11 may be of simple construction, so as to allow insertion into the union of the tubing forming the return duct 10. Shown in FIG. 2 is an embodiment wherein the return duct 10 is formed by a port 12 in the wall of crankcase 9 of the compressor 3 and by a communicating drain bore 13 in the pedestal 2 supporting the compressor. The check valve 11 consists herein of a flexible valve lamina 14, riveted to the compressor crankcase wall between pedestal 2 and crankcase 15 of the compressor 3. The valve lamina 14 controls with its free end the port 12 in the wall of crankcase 9. Space for the movement of the valve lamina 14 is provided by a recess in a gasket 16 which is rigidly clamped between the pedestal 2 and the crankcase 15.

With the engine 1 running, the compressor 3 is driven through the drive belt 4. Simultaneously, the lubricant pump 5 will, via the lubricant line 8, deliver oil to the compressor 3, and, after having lubricated the bearings and cylinder, the oil will accumulate in the crankcase 9. From the crankcase, the oil returns through the return duct 10 to the oil sump 7 in the crankcase 6 of engine 1. The check valve 11 blocks the passage in the return duct 10 toward the crankcase 9, so that oil as well as air may flow from the crankcase 9 of compressor 3 into the crankcase 6 of engine 1, but cannot flow in the opposite direction. When the piston of the compressor 3 during its suction stroke moves downward into the crankcase 9, thus causing a pressure rise therein, the check valve 11 will open, so that oil and air can escape. During the subsequent compression stroke of the compressor, with the piston moving upward and out of the crankcase, no air can flow in, so that a slight subatmospheric pressure in the crankcase 9 will result. Superatmospheric pressure in the crankcase 9 will thus be prevented. The pressure in the crankcase 9 will, also during steady-state operation or idling of the compressor 3, not - or at most only momentarily - be higher than the pressure in the compression chamber of the compressor 3. This arrangement will prevent oil in crankcase 9 from moving along the cylinder wall into the compression chamber and thus become entrained in the delivered compressed air.

The measure as per the invention, having as its object the prevention of excessive oiling of the delivered medium, can be applied with advantage not only in brake air compressors but also in other compressors for air and gases, e.g., refrigerant compressors where lubricants must be prevented from being entrained in the refrigerant.

We claim:

1. In an apparatus for generating a compressed gaseous medium which comprises a reciprocating piston compressor which includes a reciprocating piston and a crankcase, said reciprocating piston being movable away from said crankcase in a compression stroke for generating the compressed gaseous medium and then towards said crankcase in a return stroke; a storage tank for containing a lubricant, said storage tank being positioned below said crankcase; a lubricant supply line connected between the storage tank and the piston compressor for delivering lubricant from the storage tank to the piston compressor to lubricate the reciprocating piston in the piston compressor, the lubricant then accumulating in the crankcase thereof; a lubricant pump for causing lubricant to flow through said lubricant supply line; and a lubricant return line extending downwardly from the crankcase of said piston compressor to said storage tank for returning lubricant from said crankcase to the storage tank, the improvement wherein a non-return valve means is associated with said lubricant return line which allows lubricant and air to flow through said lubricant return line from said crankcase to said storage tank during a return stroke of said reciprocating piston but prevents backflow of air through said lubricant return line from said storage tank to said crankcase during a compression stroke of said reciprocating piston, thus preventing an undesirable accumulation of lubricant and undesirable build up of air pressure in said crankcase and thereby reducing the amount of lubricant that may bypass said reciprocating piston and contaminate the compressed gaseous medium provided by said reciprocating piston.

2. The apparatus as defined in claim 1, wherein said non-return valve means comprises a flexible valve lamina.

3. The apparatus as defined in claim 2, wherein said crankcase includes a floor having a port therein, and wherein said flexible valve lamina is mounted between the floor of said crankcase and said lubricant return line so as to cover said port.

4. The apparatus as defined in claim 3, wherein said crankcase is positioned on top of a support means which has a drain bore therein, said drain bore being in communication with the port in the floor of said crankcase, and wherein said flexible valve lamina is positioned between the floor of said crankcase and said support means and between said drainage bore and said port.

5. The apparatus as defined in claim 4, wherein a gasket is positioned between the floor of said crankcase and said support means, said gasket having an opening therein to allow communication between said port and said drainage bore, and wherein said flexible valve lamina is positioned in said opening in said gasket.

6. The apparatus as defined in claim 4, wherein said lubricant return line includes a duct connected between said support means and said storage tank, said duct having an upper end in communication with the drainage bore in said support means.

7. The apparatus as defined in claim 6, wherein said storage tank comprises the oil sump of an internal combustion engine and said support means comprises a pedestal attached to said internal combustion engine.

* * * * *